US011697988B2

(12) United States Patent
Aleid

(10) Patent No.: US 11,697,988 B2
(45) Date of Patent: Jul. 11, 2023

(54) METHOD AND APPARATUS FOR GENERATING ARTIFICIAL PERMEABILITY DURING COMPLETION PHASE

(71) Applicant: SAUDI ARABIAN OIL COMPANY, Dhahran (SA)

(72) Inventor: Abdulrahman K. Aleid, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/481,067

(22) Filed: Sep. 21, 2021

(65) Prior Publication Data

US 2023/0086593 A1 Mar. 23, 2023

(51) Int. Cl.

| | |
|---|---|
| ***E21B 44/02*** | (2006.01) |
| ***E21B 25/00*** | (2006.01) |
| ***E21B 49/06*** | (2006.01) |
| ***E21B 43/112*** | (2006.01) |

(52) U.S. Cl.

CPC ..... *E21B 44/02* (2013.01); *E21B 25/00* (2013.01); *E21B 43/112* (2013.01); *E21B 49/06* (2013.01)

(58) Field of Classification Search

CPC ..... E21B 44/02; E21B 25/00; E21B 43/112; E21B 49/06

See application file for complete search history.

(56) References Cited

U.S. PATENT DOCUMENTS

| | | | | |
|---|---|---|---|---|
| 1,932,612 | A * | 10/1933 | Williston | E21B 49/06 173/19 |
| 4,461,360 | A * | 7/1984 | Mount, II | E21B 49/06 175/58 |
| 7,487,846 | B2 * | 2/2009 | Head | E21B 21/00 175/75 |
| 7,588,101 | B2 * | 9/2009 | Lynde | E21B 43/114 175/67 |
| 7,778,811 | B2 * | 8/2010 | Kelfoun | E21B 47/026 703/10 |
| 9,217,328 | B2 * | 12/2015 | Yang | E21B 44/04 |
| 2016/0326804 | A1 * | 11/2016 | Gao | E21B 7/067 |

FOREIGN PATENT DOCUMENTS

| | | |
|---|---|---|
| CA | 2078402 A1 | 9/1993 |

* cited by examiner

*Primary Examiner* — Jonathan Malikasim
(74) *Attorney, Agent, or Firm* — Osha Bergman Watanabe & Burton LLP

(57) ABSTRACT

A system for generating artificial permeability during the completion phase may include sensors that capture real-time data pertaining to a reservoir parameter, a formation parameter, or a tool condition parameter. The system may also include a drilling tool arranged in a wellbore to drill, using side drill bits, paths into a formation zone based on a drilling program. The system may also include an access module to access the real-time data captured by the sensors inside the well. The system may also include one or more processors configured to arrange the drilling tool in the wellbore, in proximity to the formation zone. The one or more processors may also be configured to cause an operation of the drilling tool based on the drilling program, update the drilling program based on the real-time sensor data, and cause an adjustment of the drilling of the paths based on the updated drilling program.

18 Claims, 7 Drawing Sheets

METHOD AND APPARATUS FOR GENERATING ARTIFICIAL PERMEABILITY DURING COMPLETION PHASE

BACKGROUND

In the petroleum industry, permeability, which is the capacity of a porous material to allow fluids to pass through it, depends on the number, geometry, and size of interconnected pores, capillaries, and fractures. Permeability is an intrinsic property of porous materials and governs the ease with which fluids move through hydrocarbon reservoirs, aquifers, gravel packs, and filters.

In many materials, permeability is almost directly proportional to the material's porosity, which is the fraction of the material's total volume that is occupied by pores or voids. Textural and geological factors determine the magnitude of permeability by increasing or decreasing the cross-sectional area of open pore space.

Often to facilitate the extraction of hydrocarbons from certain formations, the original mineralogy and texture of a rock is altered. Techniques such as dissolution, dolomitization, or fracturing may be used to create additional, or secondary, porosity, which may increase permeability. However, the conventional techniques for increasing production of hydrocarbons by increasing permeability often rely on chemicals or high pressure to frack through low-permeability formations. This may result in serious danger to the health and life of the people working on the well, to the environment, and to the equipment of the well.

Accordingly, there is a need for a system for increasing the permeability of a formation without using chemicals or applying high pressure to fracture the formation.

SUMMARY

This summary is provided to introduce concepts that are further described below in the detailed description. This summary is not intended to identify key or essential features of the claimed subject matter, nor is it intended to be used as an aid in limiting the scope of the claimed subject matter.

In general, in one aspect, embodiments disclosed herein relate to a system for generating artificial permeability during the completion phase. The system includes one or more sensors arranged in a well to capture real-time sensor data pertaining to at least one of a reservoir parameter, a formation parameter, or a tool condition parameter. The system includes a drilling tool arranged in a wellbore of the well to drill, using one or more side drill bits of the drilling tool, one or more paths into a formation zone of a formation based on a drilling program. The system includes an access module operatively connected to the one or more sensors and configured to access the real-time sensor data captured by the one or more sensors inside the well. The system includes one or more hardware processors operatively connected to the access module and the drilling tool. The one or more hardware processors are configured to arrange the drilling tool in the wellbore, in proximity to the formation zone. The one or more hardware processors are also configured to cause an operation of the drilling tool based on the drilling program. The one or more hardware processors are also configured to update the drilling program based on the real-time sensor data. The one or more hardware processors are also configured to cause an adjustment of the drilling of the one or more paths based on the updated drilling program.

In general, in one aspect, embodiments disclosed herein relate to a method for generating artificial permeability during the completion phase. The method includes arranging a drilling tool in a wellbore of a well, in proximity to a formation zone identified for drilling. The method includes drilling, using one or more side drill bits of the drilling tool, one or more paths into the formation zone based on a drilling program. The method includes accessing real-time sensor data pertaining to at least one of a reservoir parameter, a formation parameter, or a tool condition parameter. The real-time sensor data is captured by one or more sensors inside the well. The method includes updating, using one or more hardware processors, the drilling program based on the real-time sensor data. The method includes adjusting the drilling of the one or more paths based on the updated drilling program.

In general, in one aspect, embodiments disclosed herein relate to a drilling tool for generating artificial permeability during the completion phase. The drilling tool may include a running base pipe. The drilling tool may include a bit base coupled to the running base pipe, the bit base being expandable, using a pressure buildup in the drilling tool, outward toward a formation. The drilling tool may include one or more tubes coupled at one end to the bit base. The tubes are expandable, using the pressure buildup in the drilling tool, outward toward the formation. The drilling tool may include one or more side drill bits coupled to the other end of the one or more tubes. The one or more side drill bits are configured to drill one or more paths in the formation at a formation zone based on a drilling program.

Other aspects and advantages of the claimed subject matter will be apparent from the following description and the appended claims.

BRIEF DESCRIPTION OF DRAWINGS

Some embodiments are illustrated by way of example and not limitation in the figures of the accompanying drawings.

DETAILED DESCRIPTION

Figure 1:
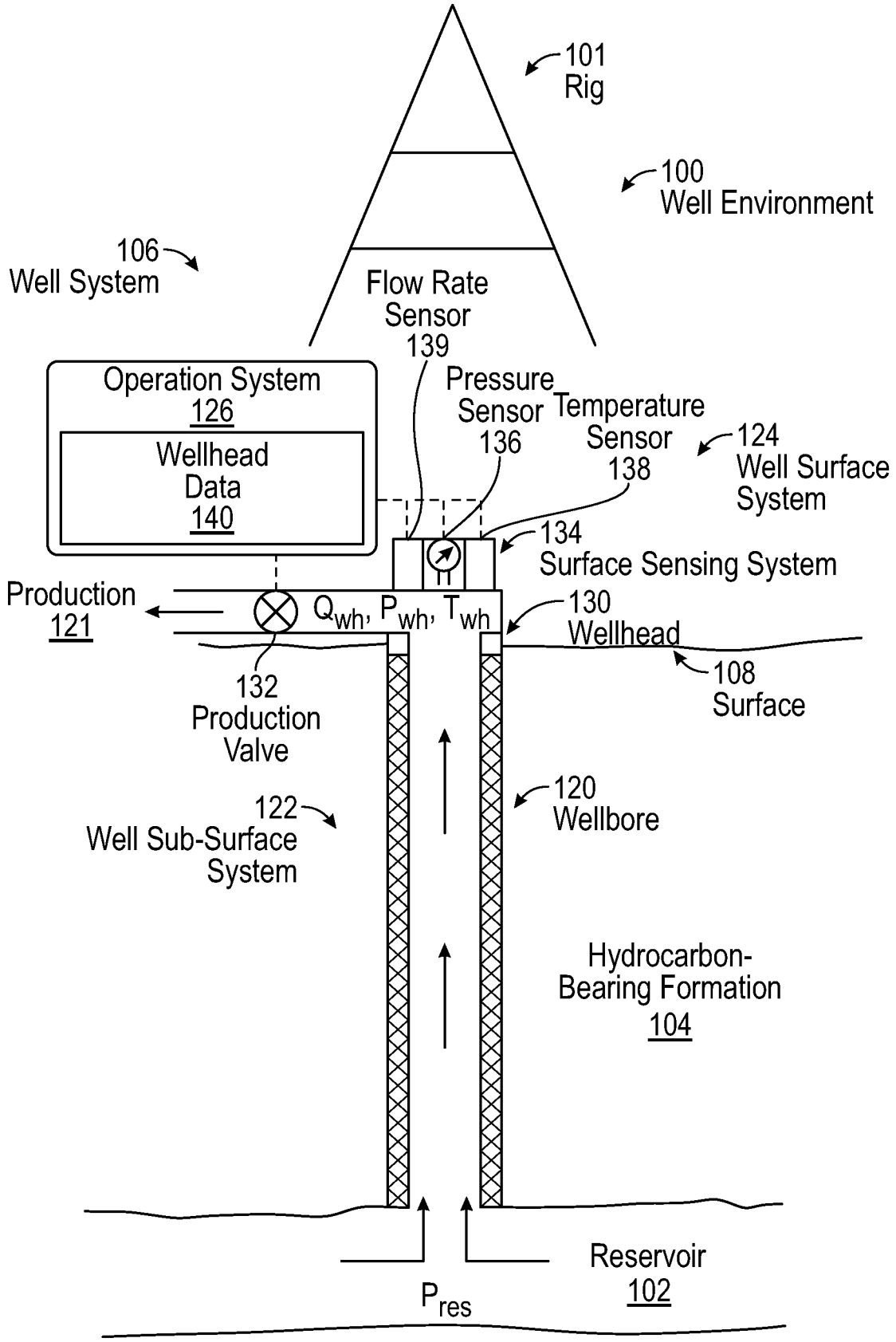
FIG. 1 illustrates a system, according to one or more example embodiments.

Example systems and methods for improving permeability of a formation are described. Unless explicitly stated otherwise, components and functions are optional and may be combined or subdivided. Similarly, operations may be combined or subdivided, and their sequence may vary.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, or third) may be used as an adjective for an element (that is, any noun in the application). The use of ordinal numbers is not to imply or create any particular ordering of the elements nor to limit any element to being only a single element unless expressly disclosed, such as using the terms "before," "after," "single," and other such terminology. Rather, the use of ordinal numbers is to distinguish between the elements. By way of an example, a first element is distinct from a second element, and the first element may encompass more than one element and succeed (or precede) the second element in an ordering of elements.

According to some example embodiments, an apparatus may be used to increase the permeability of a formation without using chemicals or applying high pressure to fracture the formation. The apparatus creates induced (or secondary) permeability during the completion phase of a well by drilling a plurality of smaller paths through a formation zone using a drilling tool that includes small side drill bits (or cutters). Once the drilling tool is arranged (or placed) at the formation zone, the small side drill bits exit the drilling tool towards the formation and start cutting paths in the formation rock. The cut paths create induced permeability (K), and the length and size of the cut paths is predetermined to optimize induced permeability. The apparatus may also comprise one or more smart sensors to capture and communicate real-time data pertaining to at least one of a reservoir condition or a condition. In addition, the apparatus facilitates the cutting of rock samples from the formation and the collection of these samples for later analysis. The apparatus for inducing secondary permeability (hereinafter also "system") provides the following improvements over existing systems/tools. No chemicals are needed to create artificial or induced permeability of the formation, as the tool fractures a path through a formation zone. By minimizing the use of chemicals that can affect the reservoir and avoiding applying high pressure to fracture the formation, the downhole environment is made safer. Further, by using small drill bits to drill small holes in the formation and by not pumping fluid into the formation, the apparatus limits skin damage to the formation. Skin damage is a dimensionless value that represents how much damage is inflicted on the formation due to drilling into the formation. The apparatus and method disclosed herein also allow for communication with the reservoir and data collection from the downhole environment up to the surface. For example, such data collection may be the product of real-time sensor data observed/measured by the apparatus/tool. This data may be used to update the drilling program, and to cause an adjustment of the drilling of the one or more paths based on the updated drilling program. Another advantage is calculated access to determine the depth of the exposure in the reservoir. The collected data allows for more accurate characterization of the downhole formation rocks. The collected data may include data pertaining to pressure, temperature, and fluid quality. The collected data may also include the length of the cut paths which may be used to calculate the total reservoir exposure.

In some example embodiments, the apparatus for inducing secondary permeability includes one or more sensors arranged in a well to capture real-time sensor data pertaining to at least one of a reservoir parameter, a formation parameter, or a tool condition parameter. The apparatus also includes a drilling tool arranged in a wellbore of the well to drill, using one or more side drill bits of the drilling tool, one or more paths into a formation zone of a formation. The drilling may be performed based on a drilling program. In some instances, the drilling program may include one or more paths calculated for drilling in the formation zone, a type of fluid used to drill, rate of penetration (ROP), weight on bit (WOB), angles the mini drill bits should enter the formation zone, etc. In addition, the apparatus may include an access module operatively connected to the one or more sensors and configured to access the real-time sensor data captured by the one or more sensors inside the well. Furthermore, the apparatus includes one or more hardware processors operatively connected to the access module and the drilling tool. The one or more hardware processors are configured to arrange the drilling tool in the wellbore, in proximity to the formation zone, to cause an operation of the drilling tool based on the drilling program, to update the drilling program based on the real-time sensor data, and to cause an adjustment of the drilling of the one or more paths based on the updated drilling program. In some instances, the drilling is performed using a pressure buildup in the drilling tool.

In various example embodiments, the one or more side drill bits are coupled to a running base pipe of the drilling tool, which forms the center part of the drilling tool, via a bit base of the drilling tool. The causing of the operation of the drilling tool may include expanding, using pressure buildup in the drilling tool, the bit base outward toward the formation to arrange the one or more side drill bits in proximity of the formation zone. The causing of the operation of the drilling tool may also include retracting, upon completing the drilling program, the bit base inward toward the running base pipe of the drilling tool.

In certain example embodiments, the one or more side drill bits are coupled to the running base pipe of the drilling tool via tubes (e.g., loaded tubes). The causing of the operation of the drilling tool may include expanding a tube of a particular side drill bit of the one or more side drill bits outward toward the formation to arrange the particular side drill bit in proximity of the formation zone. In addition, the causing of the operation of the drilling tool may include pushing, using pressure buildup in the drilling tool, the tube outward toward the formation to cause the particular side drill bit to cut into the formation. The pushing of the tube results in an expansion of the tube to a length of the tube. The length of the tube may be determined based on a drilling path calculated for the particular side drill bit.

Consistent with some example embodiments, the drilling includes cutting one or more core samples out of the formation at the formation zone during the operation of the drilling tool. The cutting may be performed using the one or more side drill bits of the drilling tool. The drilling may also include collecting the one or more core samples using a core catcher of the drilling tool. The drilling tool may also transport the collected core samples to the surface for later analysis of the core samples.

FIG. 1 shows a schematic diagram of a system, in accordance with one or more embodiments. FIG. 1 illustrates a well environment 100 that includes a hydrocarbon reservoir ("reservoir") 102 located in a subsurface hydrocarbon-bearing formation ("formation") 104 and a well system 106. The hydrocarbon-bearing formation 104 may include a porous or fractured rock formation that resides underground, beneath the earth's surface ("surface") 108. In the case of the well system 106 being a hydrocarbon well, the reservoir 102 may include a portion of the hydrocarbon-bearing formation 104. The hydrocarbon-bearing formation 104 and the reservoir 102 may include different layers of rock having varying characteristics, such as varying degrees of permeability, porosity, capillary pressure, and resistivity. In the case of the well system 106 being operated as a production well, the well system 106 may facilitate the extraction (or "production") of hydrocarbons from the reservoir 102.

In some embodiments disclosed herein, the well system 106 includes a rig 101, a wellbore 120, a well sub-surface system 122, a well surface system 124, and an operation system 126. The operation system 126 may control various operations of the well system 106, such as well production operations, well completion operations, well maintenance operations, and reservoir monitoring, assessment and development operations. In some embodiments, the operation system 126 includes a computer system that is the same as or similar to computing system 1100 described below in FIG. 11, and the accompanying description.

The rig 101 is the machine used to drill a borehole to form the wellbore 120. Major components of the rig 101 include the mud tanks, the mud pumps, the derrick or mast, the drawworks, the rotary table or topdrive, the drillstring, the power generation equipment, and auxiliary equipment.

The wellbore 120 includes a bored hole (i.e., borehole) that extends from the surface 108 into a target zone of the hydrocarbon-bearing formation 104, such as the reservoir 102. An upper end of the wellbore 120, terminating at or near the surface 108, may be referred to as the "up-hole" end of the wellbore 120, and a lower end of the wellbore, terminating in the hydrocarbon-bearing formation 104, may be referred to as the "downhole" end of the wellbore 120. The wellbore 120 may facilitate the circulation of drilling fluids during drilling operations, the flow of hydrocarbon production ("production") 121 (e.g., oil, gas, or both) from the reservoir 102 to the surface 108 during production operations, the injection of substances (e.g., water) into the hydrocarbon-bearing formation 104 or the reservoir 102 during injection operations, or the communication of monitoring devices (e.g., logging tools) into the hydrocarbon-bearing formation 104 or the reservoir 102 during monitoring operations (e.g., during in situ logging operations).

According to some example embodiments, to increase the production from hydrocarbon-bearing formation 104, a drilling tool is used generate fractures in the rock of hydrocarbon-bearing formation 104. The generated fractures induce additional permeability in hydrocarbon-bearing formation 104. The drilling tool may be lowered into wellbore 120 and may be arranged at a particular depth, in a proximity of a zone of hydrocarbon-bearing formation 104, that has been identified for fracturing.

The drilling tool may comprise a running base pipe which forms the center portion of the tool. The drilling tool may also include a bit base coupled to the running base pipe. The bit base is expandable (e.g., using pressure buildup in the drilling tool) outward toward the zone of hydrocarbon-bearing formation 104, identified for fracturing. In addition, the drilling tool comprises one or more tubes. The one or more tubes are coupled, at one end of the tubes, to the bit base and, at the other end of the tubes, to one or more side drill bits. The tubes are expandable (e.g., using pressure buildup in the drilling tool) outward toward the formation. The expansion of the tubes causes the movement of the one or more drill bits toward and into hydrocarbon-bearing formation 104. The one or more side drill bits are configured to drill one or more paths in hydrocarbon-bearing formation 104 at a formation zone based on a drilling program.

In some embodiments, during operation of the well system 106, the operation system 126 collects and records wellhead data 140 for the well system 106. The wellhead data 140 may include, for example, a record of measurements of wellhead pressure values ($P_{wh}$) (e.g., including flowing wellhead pressure values), wellhead temperature values ($T_{wh}$) (e.g., including flowing wellhead temperature values), wellhead multiphase production rates ($Q_{wh}$) over some or all of the life of the well system 106, and water cut data. In some embodiments, the measurement values are recorded in real-time, and are available for review or use within seconds, minutes, or hours of the condition being sensed (e.g., the measurements are available within one hour of the condition being sensed). In such an embodiment, the wellhead data 140 may be referred to as "real-time" wellhead data 140. Real-time wellhead data 140 may enable an operator of the well system 106 to assess a relatively current state of the well system 106, and make real-time decisions regarding development or management of the well system 106 and the reservoir 102, such as on-demand adjustments in regulation of production flow from the well. In some instances, the real-time decisions are performed automatically.

In some embodiments, the well sub-surface system 122 includes casing installed in the wellbore 120. For example, the wellbore 120 may have a cased portion and an uncased (or "open-hole") portion. The cased portion may include a portion of the wellbore having casing (e.g., casing pipe and casing cement) disposed therein. The uncased portion may include a portion of the wellbore not having casing disposed therein. In some embodiments, the casing includes an annular casing that lines the wall of the wellbore 120 to define a central passage that provides a conduit for the transport of tools and substances through the wellbore 120. For example, the central passage may provide a conduit for lowering logging tools into the wellbore 120, a conduit for the flow of production 121 (e.g., oil and gas) from the reservoir 102 to the surface 108, or a conduit for the flow of injection substances (e.g., water) from the surface 108 into the hydrocarbon-bearing formation 104. In some embodiments, the well sub-surface system 122 includes production tubing installed in the wellbore 120. The production tubing may provide a conduit for the transport of tools and substances through the wellbore 120. The production tubing may, for example, be disposed inside casing. In such an embodiment, the production tubing may provide a conduit for some or all of the production 121 (e.g., oil and gas) passing through the wellbore 120 and the casing.

In some embodiments, the well surface system 124 includes a wellhead 130. The wellhead 130 may include a rigid structure installed at the "up-hole" end of the wellbore 120, at or near where the wellbore 120 terminates at the Earth's surface 108. The wellhead 130 may include structures for supporting (or "hanging") casing and production tubing extending into the wellbore 120. Production 121 may flow through the wellhead 130, after exiting the wellbore 120 and the well sub-surface system 122, including, for example, the casing and the production tubing. In some embodiments, the well surface system 124 includes flow regulating devices that are operable to control the flow of substances into and out of the wellbore 120. For example, the well surface system 124 may include one or more production valves 132 that are operable to control the flow of production 134. A production valve 132 may be fully opened to enable unrestricted flow of production 121 from the wellbore 120. Further, the production valve 132 may be partially opened to partially restrict (or "throttle") the flow of production 121 from the wellbore 120. In addition, the production valve 132 may be fully closed to fully restrict (or "block") the flow of production 121 from the wellbore 120, and through the well surface system 124.

In some embodiments, the wellhead 130 includes a choke assembly. For example, the choke assembly may include hardware with functionality for opening and closing the fluid flow through pipes in the well system 106. Likewise, the choke assembly may include a pipe manifold that may lower the pressure of fluid traversing the wellhead. As such, the choke assembly may include a set of high-pressure valves and at least two chokes. These chokes may be fixed or adjustable or a mix of both. Redundancy may be provided so that if one choke is taken out of service, the flow can be directed through another choke. In some embodiments, pressure valves and chokes are communicatively coupled to the operation system 126. Accordingly, the operation system 126 may obtain wellhead data regarding the choke assembly as well as transmit one or more commands to components within the choke assembly in order to adjust one or more choke assembly parameters.

Keeping with FIG. 1, in some embodiments, the well surface system 124 includes a surface sensing system 134. The surface sensing system 134 may include sensors for sensing characteristics of substances, including production 121, passing through or otherwise located in the well surface system 124. The characteristics may include, for example, pressure, temperature and flow rate of production 121 flowing through the wellhead 130, or other conduits of the well surface system 124, after exiting the wellbore 120. The surface sensing system 134 may also include sensors for sensing characteristics of the rig 101, such as bit depth, hole depth, drilling mudflow, hook load, rotary speed, etc.

In some embodiments, the surface sensing system 134 includes a surface pressure sensor 136 operable to sense the pressure of production 151 flowing through the well surface system 124, after it exits the wellbore 120. The surface pressure sensor 136 may include, for example, a wellhead pressure sensor that senses a pressure of production 121 flowing through or otherwise located in the wellhead 130. In some embodiments, the surface sensing system 134 includes a surface temperature sensor 138 operable to sense the temperature of production 151 flowing through the well surface system 124, after it exits the wellbore 120. The surface temperature sensor 138 may include, for example, a wellhead temperature sensor that senses a temperature of production 121 flowing through or otherwise located in the wellhead 130, referred to as "wellhead temperature" ($T_{wh}$). In some embodiments, the surface sensing system 134 includes a flow rate sensor 139 operable to sense the flow rate of production 151 flowing through the well surface system 124, after it exits the wellbore 120. The flow rate sensor 139 may include hardware that senses a flow rate of production 121 ($Q_{wh}$) passing through the wellhead 130. In some embodiments, downhole sensors and gauges are operable to capture production-related data (e.g., pressures, temperatures, etc.).

While FIG. 1 illustrates a configuration of components, other configurations may be used without departing from the scope of the disclosure. For example, various components in FIG. 1 may be combined to create a single component. As another example, the functionality performed by a single component may be performed by two or more components.

Figure 2:
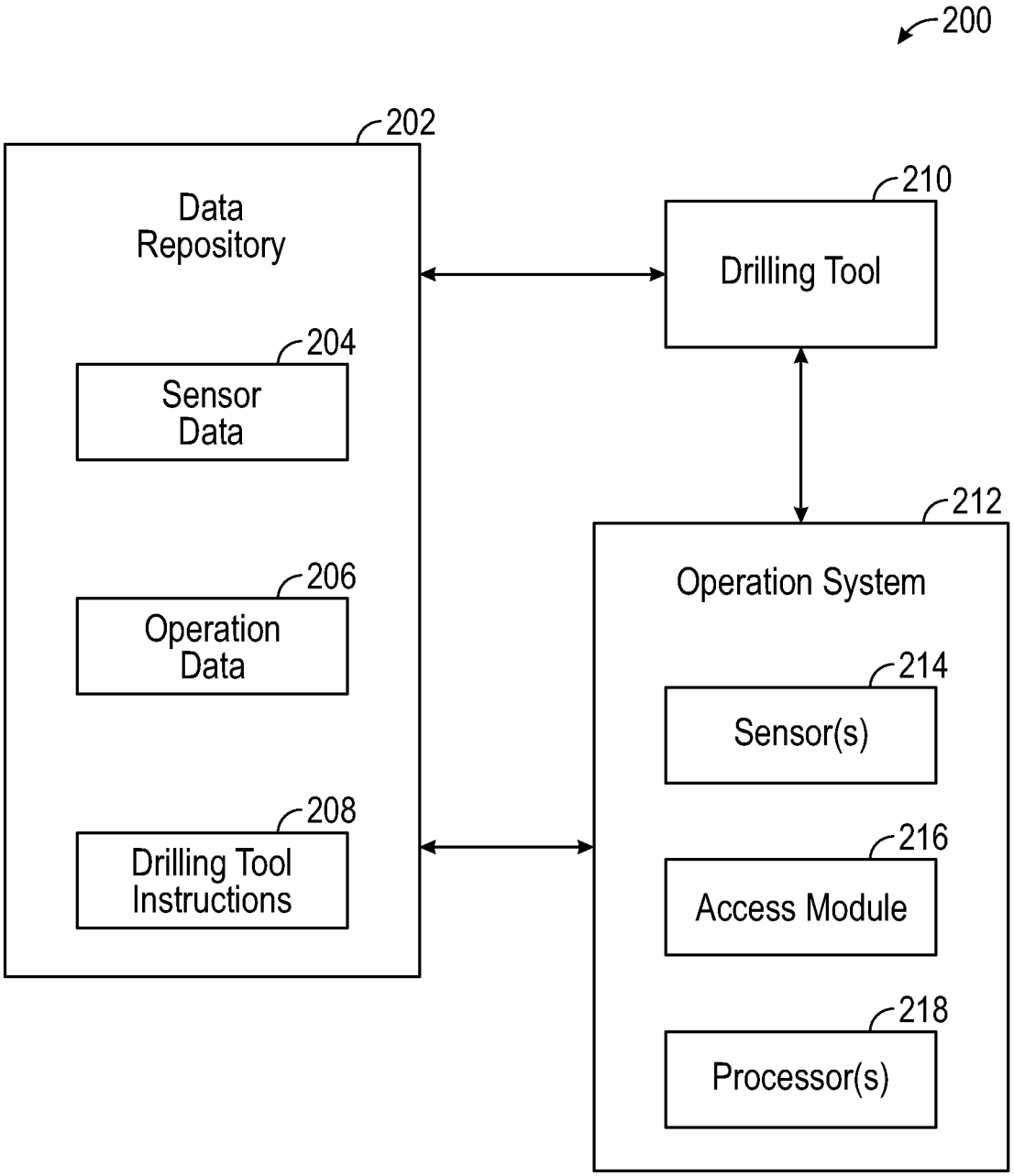
FIG. 2 is a block diagram that illustrates a system for improving permeability of a formation, according to one or more example embodiments.

FIG. 2 is a block diagram that illustrates a system 200 for improving permeability of a formation, according to one or more example embodiments. System 200 includes an operation system 212, a data repository 202, and a drilling tool 210. The operation system 212 is shown as including one or more sensors 214, an access module 216, and one or more processors 218. The one or more sensors 214, in some example embodiments, are smart sensors that capture real-time data pertaining to reservoir parameters (e.g., a pressure value), formation parameters (e.g., presence of gases), or tool condition parameters (e.g., temperature, vibration, revolutions per minute (RPM), etc.). In some instances, the smart sensors transmit the captured real-time data to other parts of system 200 in real time (or near real time) by wired or wireless communications. In some instances, the smart sensors store the captured real-time data in a downhole memory for later transmittal to the surface. The downhole memory may or may not be part of the drilling tool 210. In some example embodiments, the one or more sensors 214 are included in (e.g., arranged on, located on, or placed on) the drilling tool 210. In certain example embodiments, the one or more sensors 214 are located downhole, externally to the drilling tool 210. The components of the operation system 212 are operatively connected and are configured to communicate with each other (e.g., via a bus, shared memory, a switch, wirelessly, etc.). In addition, the operation system 212 is configured to communicate with the data repository 202 and the drilling tool 210.

The one or more sensors 214 are arranged to capture real-time data associated with a parameter (e.g., a pressure or a temperature) over a certain period. The real-time data captured by the one or more sensors 214 may be stored as sensor data 204 in the data repository 202. The access module 216 may access the real-time sensor data 204 and may use this data as input for updating a drilling program to reflect the most-recent conditions associated with a drilling operation.

The one or more processors 218 are configured, in some example embodiments, to arrange the drilling tool 210 in a wellbore of the well, in proximity to a formation zone that has been identified for fracturing using the drilling tool 210. For example, the drilling tool 210 may be lowered to a certain depth in the wellbore. The depth value and information identifying the formation zone may be stored as operation data 206 in the data repository 202.

The one or more processors 218 are further configured to cause an operation of the drilling tool 210 based on a drilling program. Further, the one or more processors 218 are further configured to update the drilling program based on the real-time sensor data. In addition, the one or more processors 218 are further configured to cause an adjustment of the drilling of the one or more paths based on the updated drilling program. The drilling program may be executed on a computing device such as that shown in FIG. 11.

In some example embodiments, the updating, by the one or more processors 218, of the drilling program includes determining a condition pertaining to at least one of a reservoir parameter, a formation parameter, or a tool condition parameter, and modifying an attribute of the one or more paths based on the determined condition. For example, if a processor 218 determines that the density of the rock in the original direction of the path is higher than a certain threshold value, then the processor 218 may modify the direction of the path. This may prevent a premature dulling or breakage of the side drill bits of the drilling tool. Further, the updating, by the one or more processors 218, of the drilling program includes generating, by a processor 218, an instruction for the drilling tool to make an adjustment to the drilling of the one or more paths based on the modified attribute of the one or more paths. The causing of the adjustment of the drilling of the one or more paths based on the updated drilling program may include executing of the generated instruction during a drilling process performed by the drilling tool 210. As shown in FIG. 2, generated instructions may be stored as drilling tool instructions 208 in the data repository 202.

Figure 3:
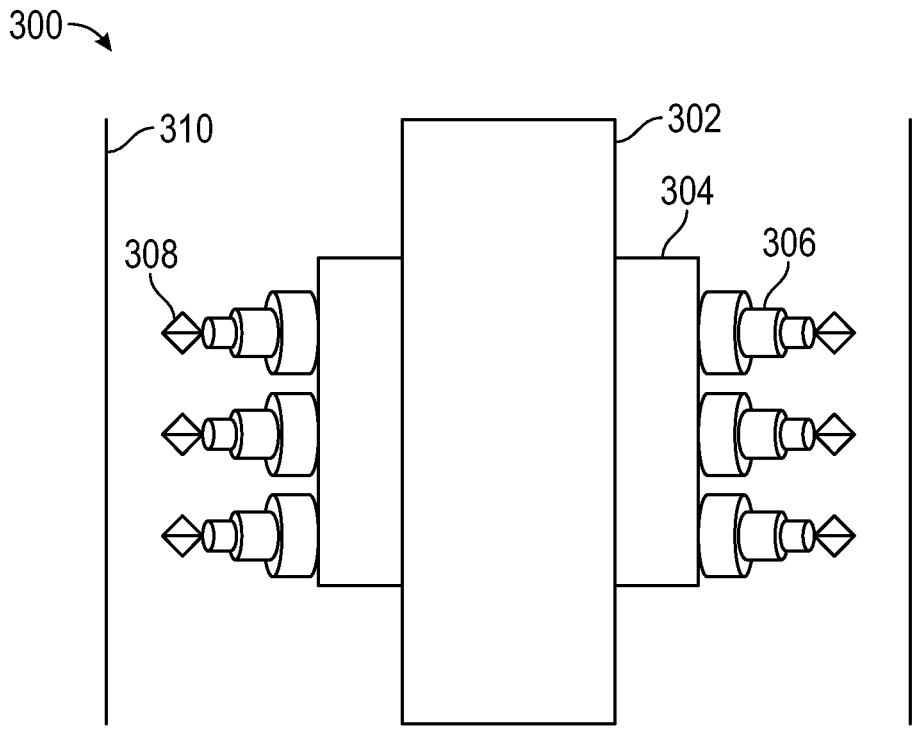
FIGS. 3-9 are schematic illustrations of a drilling tool for improving permeability of a formation, according to one or more example embodiments.

FIGS. 3-9 are schematic illustrations of an apparatus/drilling tool for improving permeability of a formation, according to one or more example embodiments. As shown in FIG. 3, the drilling tool 300 for generating fractures in the rock of a formation comprises a running base pipe 302 which forms the center portion of the drilling tool 300. In some instances, the running base pipe 302 is coupled to a drillstring of a drilling system. For example, the drilling tool is screwed into the bottom of the drill pipe using threads. Then, the drill pipe would be lowered into the hole to a pre-determined depth.

The drilling tool 300 also includes a bit base 304 coupled to the running base pipe 302. In addition, the drilling tool 300 comprises one or more tubes (e.g., loaded tubes) 306 coupled at one end to the bit base 304 and, at the other end, to one or more side drill bits 308. The one or more side drill bits 308 are configured to drill one or more paths in a formation 310 at a formation zone based on a drilling program.

Figure 4:
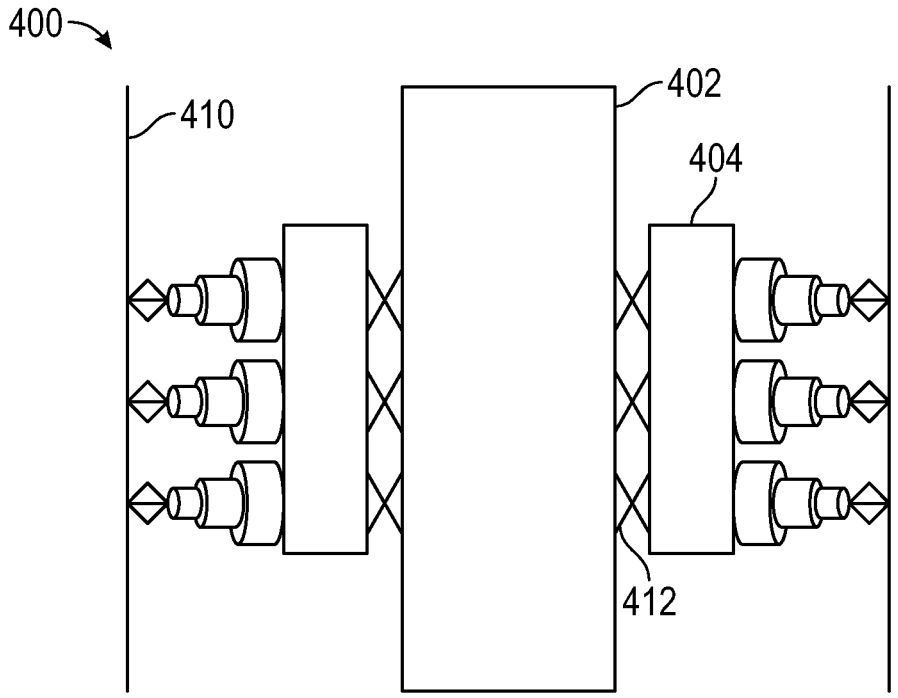

As shown in FIG. 4, the bit base 404 may be expanded using one or more expansion units 412. The expansion units 412 may be a sophisticated mechanical array that uses a pressurized system and an electronic system to expand whenever needed for the extension and reach of the bit to the proposed depth in the formation upon activation and deactivation of a piston for moving the bit base 404. The expansion units 412 may use pressure buildup in the drilling tool to move the bit base 404 outward from the running base pipe 402 toward the zone of formation 410, identified for fracturing. In some instances, the pressure buildup is achieved based on pumping water or a drilling fluid through the inside of the drill pipe and into the drilling tool. The pressure builds up in the drilling tool and pushes the drill bits into the formation.

Figure 5:
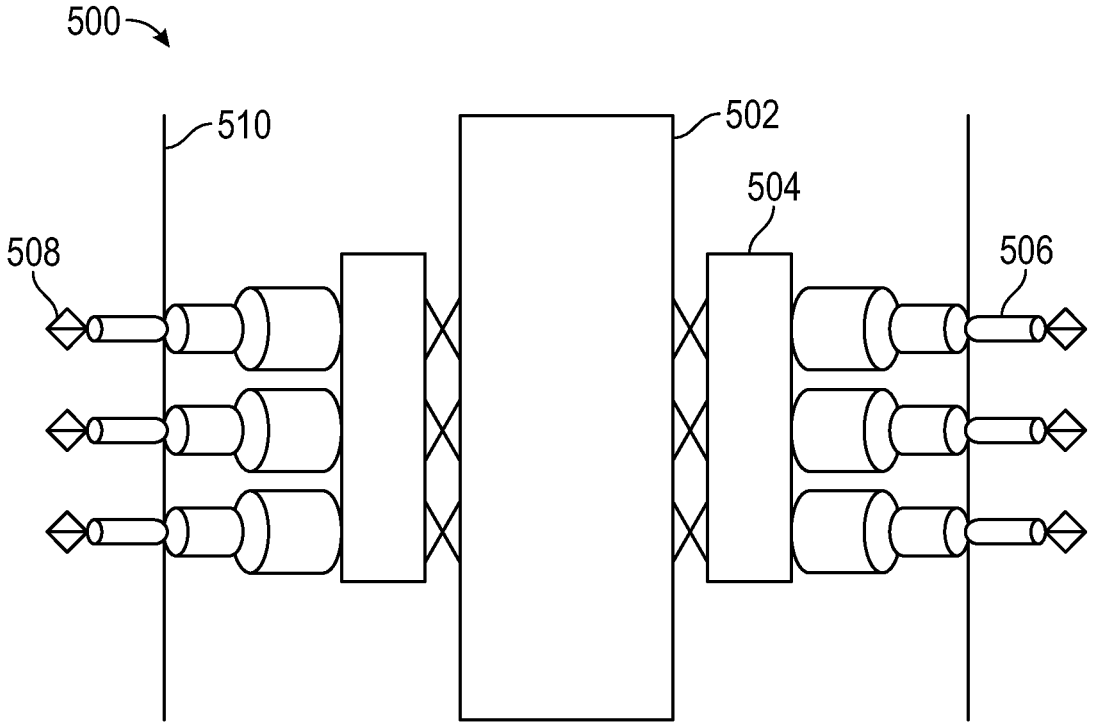

As shown in FIG. 5, the tubes 506 may be expanded (e.g., in a telescope-like manner) outward from the running base pipe 502 and the bit base 504 toward the formation 510. The expansion of the tubes 506 causes the movement of the one or more side drill bits 508 toward and into formation 510. The tubes 506 may be expanded using pressure buildup in the drilling tool. In some example embodiments, the system uses a hydraulic processing unit (HPU) to activate or deactivate, as well as to pressurize or depressurize, a piston for expanding and contracting the tubes 506. The length of the expansion of a particular tube 506 is calculated based on a planned path associated with the particular tube 506.

Figure 6:
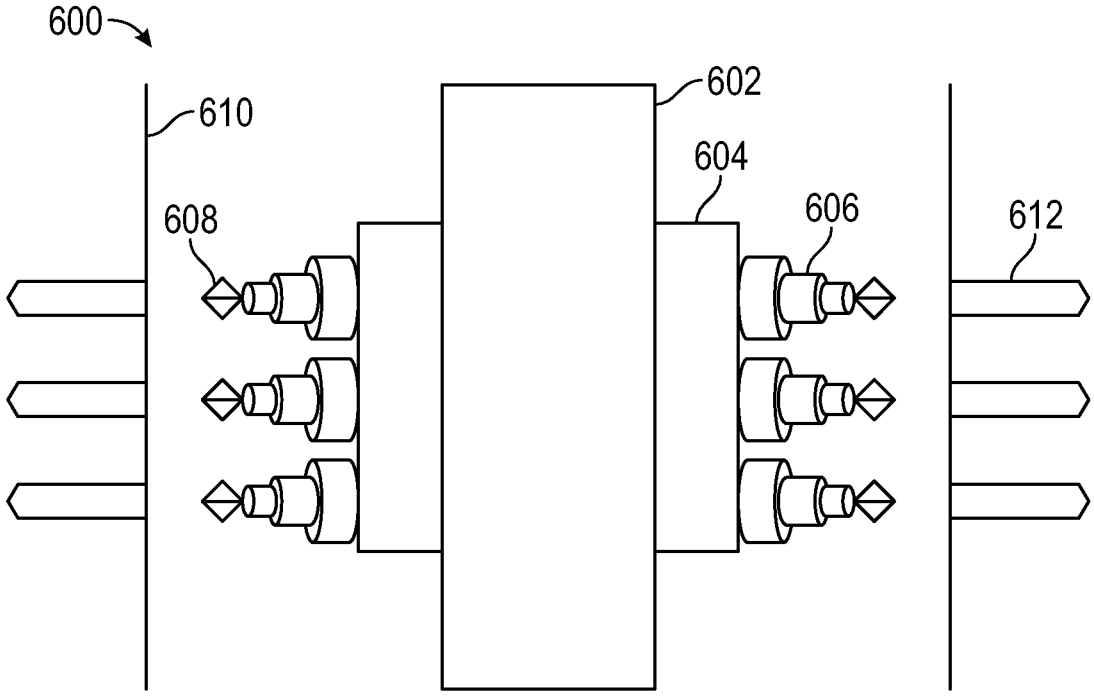

As shown in FIG. 6, upon completing one or more paths 612 into the formation zone 610 (or upon completing the drilling program), the tubes 506 may be retracted (or collapsed) inward toward the bit base 604 and the running base pipe 602 of the drilling tool 600. This results in the drilling bits 608 being withdrawn from the paths 612. When the tubes 506 and the drilling bits 608 are determined (e.g., by one or more sensor) to be fully removed from the formation 610, the drilling tool 600 may be removed from the well.

Figure 7:
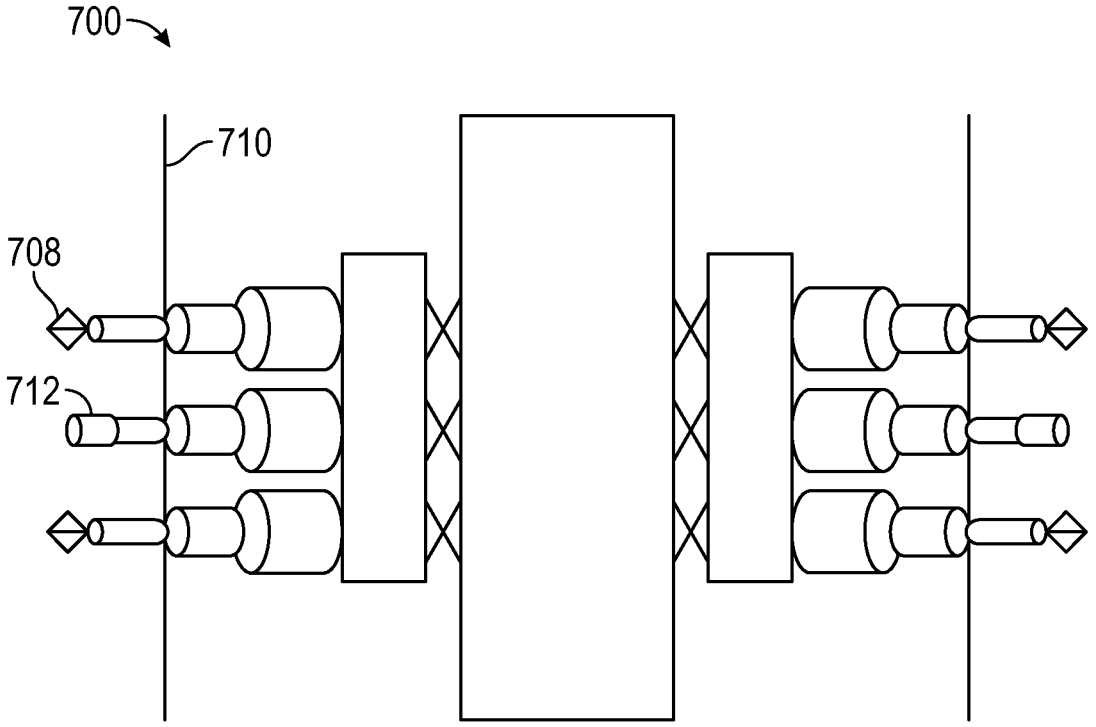

As shown in FIG. 7, the drilling tool 700 cuts one or more core samples 712 out of the formation 710 at the formation zone. The cutting is performed using the one or more side drill bits 708 of the drilling tool 700. The one or more core samples 712 are collected and stored using a core catcher of the drilling tool 700.

Figure 8:
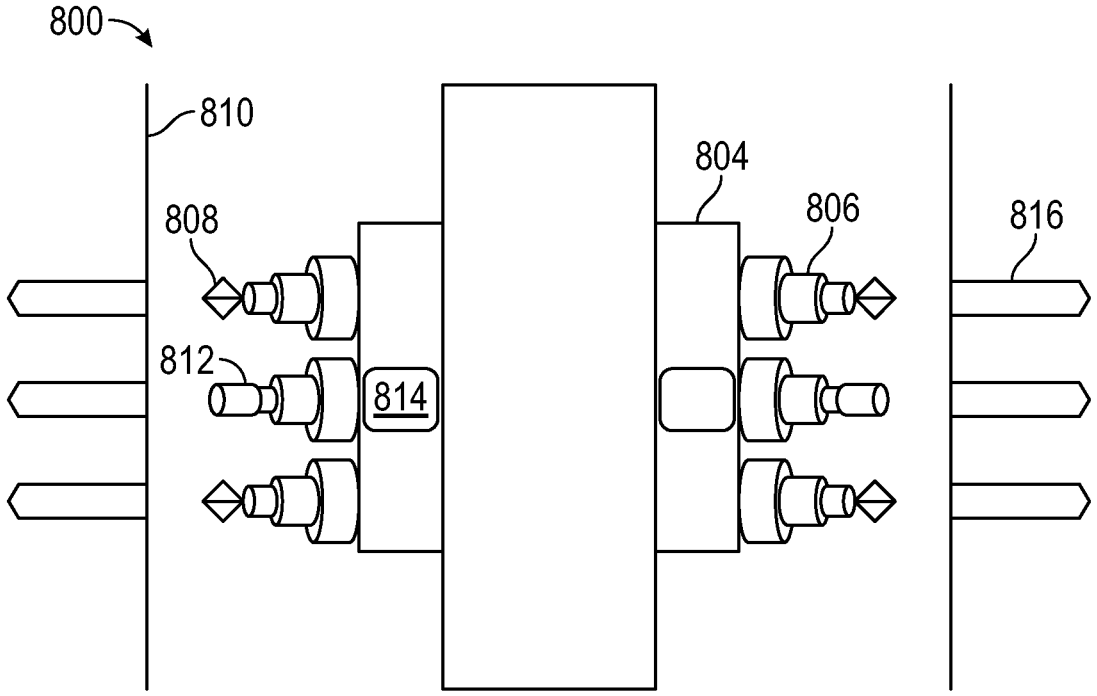

FIG. 8 illustrates the core catcher 814 which is arranged within the bit base 804. The core catcher 814 accesses (e.g., receives) the core sample 812, which was cut from the path 816 drilled in the formation 810, via the tube 806 from the side drill bit 808. The drilling tool 800 may transmit or transport the core 812 to the surface upon the completion of the drilling process.

Figure 9:
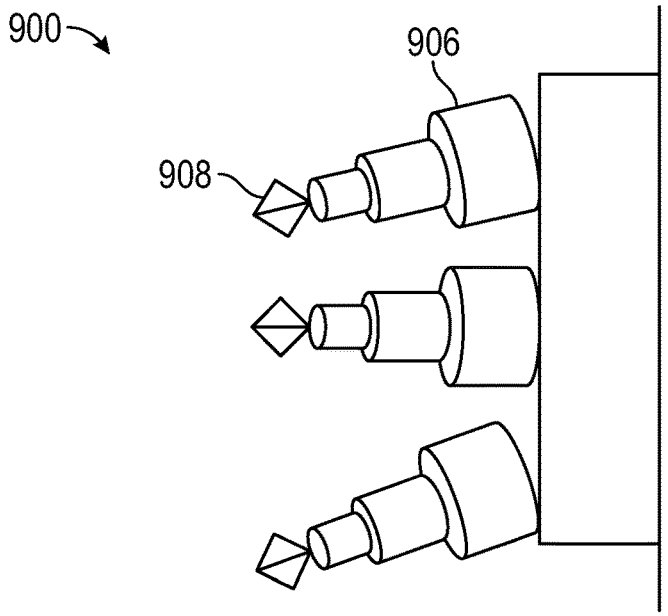

As shown in FIG. 9, various side drill bits 908 coupled to the tubes 906 may be adjusted to specific angles based on the individual path being drilled for the particular side drill bit 908. In some example embodiments, the specific angle associated with a particular side drill bit 908 is adjusted based on an adjusted path associated with the particular side drill bit 908.

Figure 10:
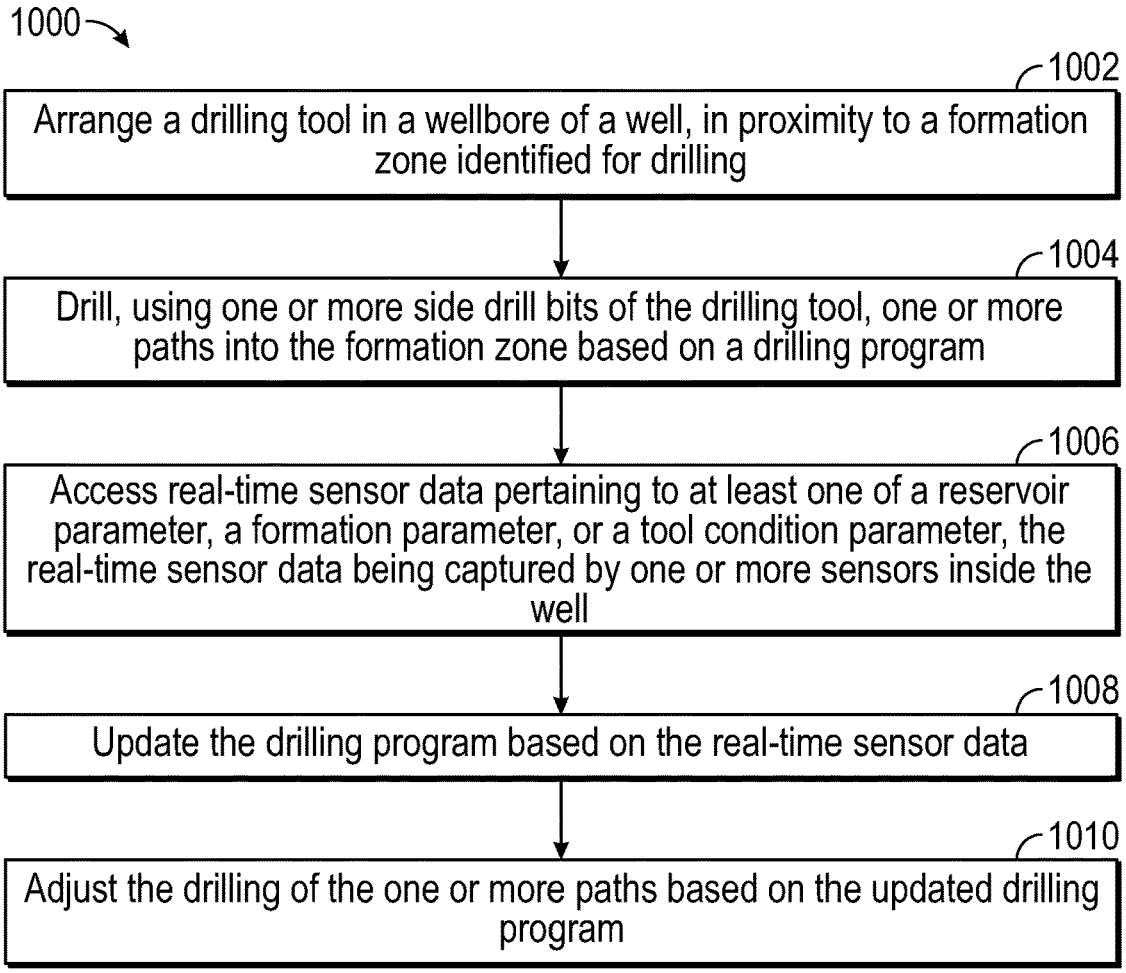
FIG. 10 is a flowchart illustrating operations of a system in performing a method for improving permeability of a formation, according to one or more example embodiments.

FIG. 10 is a flowchart illustrating operations of the operation system 212 in performing a method for improving permeability of a formation, according to one or more example embodiments. Steps of the method 1000 may be performed using the components described above with respect to FIG. 2. One or more blocks in FIG. 10 may be performed by a computing system such as that shown and described below in FIG. 11. While the various blocks in FIG. 10 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

At Step 1002, one or more processors 218 arrange a drilling tool in a wellbore of a well, in proximity to a formation zone identified for drilling. For example, the drilling tool 210 may be lowered to a certain depth in the wellbore. The depth value and the data identifying the formation zone may be stored as operation data 206 in the data repository 202. The processor 218 may access the depth value and the data identifying the formation zone from the data repository 202.

At Step 1004, the drilling tool 210 drills, using one or more side drill bits of the drilling tool 210, one or more paths into the formation zone based on a drilling program. In some example embodiments, the drilling is performed by inducing a pressure within the drilling tool based on pumping a fluid from the surface into the drilling tool. The method of FIG. 10 to artificially create a path K may involve penetrating through the formation by simply drilling into the formation wall until a stopping point is reached, or coring through the formation by drilling into the formation wall using a cored bit. Both methods result in the same size of K. Coring through the formation allows retrieval of the core and for data analysis.

According to various example embodiments, the one or more side drill bits are coupled to a running base pipe of the drilling tool 210 via a bit base of the drilling tool 210. The bit base may expand outward toward the formation to arrange the one or more side drill bits in proximity of the formation zone. Upon completing the drilling program, the bit base may be retracted inward toward the running base pipe of the drilling tool.

In certain example embodiments, the one or more side drill bits are coupled to a running base pipe of the drilling tool 210 via tubes. The tube of a particular side drill bit of the one or more side drill bits may expand outward toward the formation to arrange the particular side drill bit in proximity of the formation zone. Using pressure buildup in the drilling tool, the tube may be pushed outward toward the formation to cause the particular side drill bit to cut into the formation. The pushing of the tube results in an expansion of the tube to a length of the tube. The length of the tube is determined based on a drilling path calculated, by the processor 218, for the particular side drill bit. That is, the length of the path/K is calculated and reflected in the tube length. The length of the tube expansion multiplied by the diameter of the bit determines the total area of path exposure.

In various example embodiments, the drilling of the one or more paths into the formation zone includes cutting one or more core samples out of the formation at the formation zone. The cutting is performed using the one or more side drill bits of the drilling tool. The drilling may also include collecting the one or more core samples using a core catcher of the drilling tool 210.

Consistent with some example embodiments, the drilling of the one or more paths into the formation zone includes adjusting a particular side drill bit of the one or more side drill bits to a specific angle based on the adjusted path for the particular side drill bit.

At Step 1006, the access module 216 accesses real-time sensor data 204 pertaining to at least one of a reservoir parameter, a formation parameter, or a tool condition parameter. The real-time sensor data 204 is captured by one or more sensors 214 inside the well. The real-time sensor data 204 may be accessed from a database or may be received from the sensors 214 in real-time.

At Step 1008, the one or more processors 218 update the drilling program based on the real-time sensor data 204. In some example embodiments, the updating of the drilling program based on the real-time sensor data includes calculating the drilling path for the particular side drill bit based on the real-time sensor data. In some instances, the one or more processors 218 may determine, based on the real-time sensor data, that the particular drilling path may be longer than previously planned. In other instances, the one or more processors 218 may determine, based on the real-time sensor data, that the direction of the particular drilling path should be changed by a particular angle.

In some example embodiments, the updating of the drilling program includes determining, by the one or more processors 218, a condition pertaining to the at least one of the reservoir parameter, the formation parameter, or the tool condition parameter. The updating of the drilling program also includes modifying an attribute of the one or more paths based on the determined condition. In addition, the updating of the drilling program includes generating an instruction for the drilling tool to make an adjustment to the drilling of the one or more paths based on the modified attribute of the one or more paths. The adjusting of the drilling of the one or more paths includes executing the instruction during a drilling process performed by the drilling tool 210.

In certain example embodiments, upon completing the drilling program, the tube of the particular side drill bit is retracted inward toward the running base pipe of the drilling tool 210. Then, the drilling tool 210 may be removed from the well.

At Step 1010, the drilling tool 210 adjusts the drilling of the one or more paths based on the updated drilling program.

Figure 11:
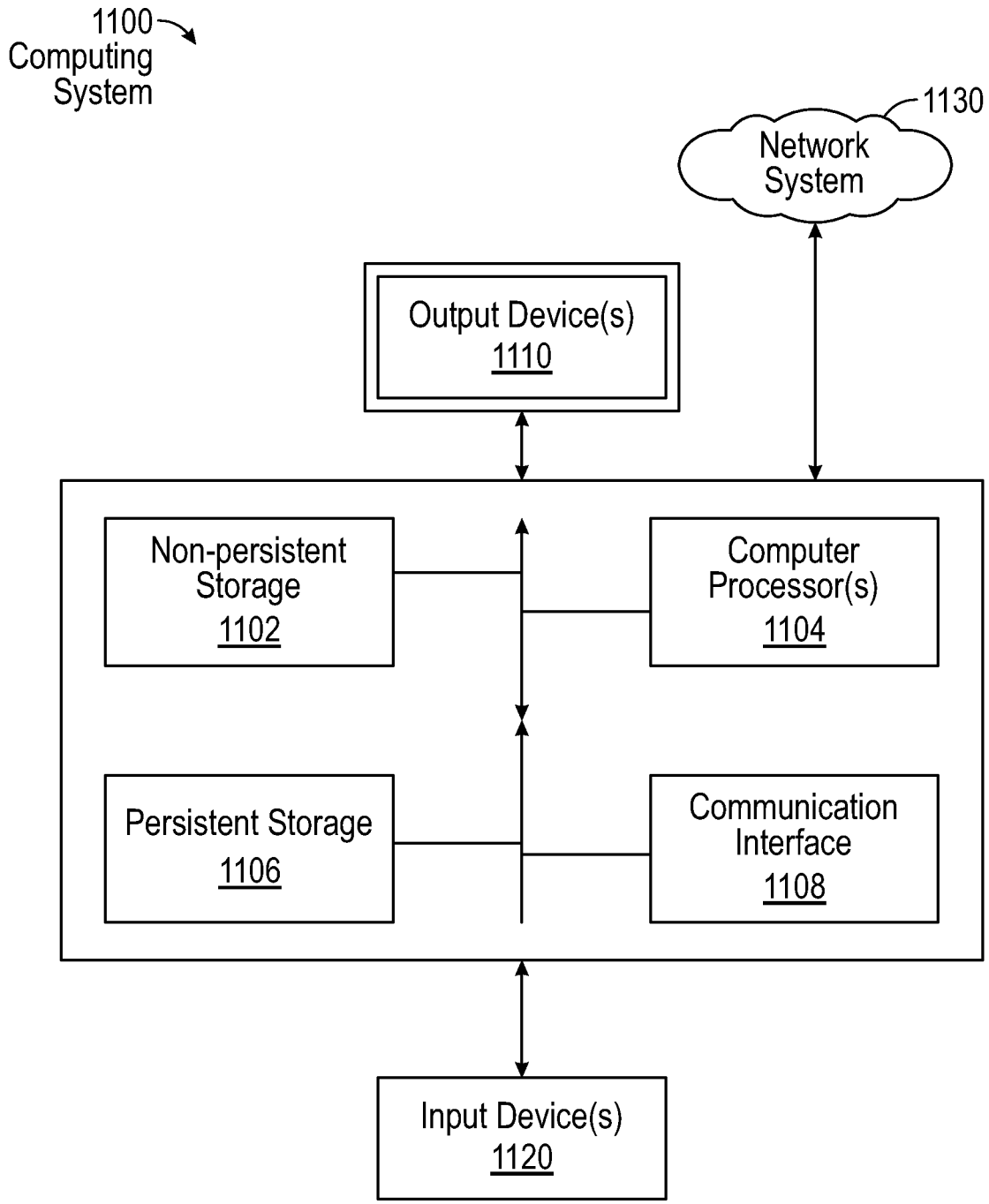
FIG. 11 illustrates a computing system, according to one or more example embodiments.

Turning to FIG. 11, FIG. 11 shows a computing system in accordance with one or more embodiments. As shown in FIG. 11, the computing system 1100 may include one or more computer processor(s) 1104, non-persistent storage 1102 (e.g., random access memory (RAM), cache memory, or flash memory), persistent storage 1106 (e.g., a hard disk), a communication interface 1108 (e.g., transmitters and/or receivers), as well as other elements. The computer processor(s) 1104 may be an integrated circuit for processing instructions. The computing system 1100 may also include one or more input device(s) 1120, such as a touchscreen, a keyboard, a mouse, a microphone, a touchpad, an electronic pen, or any other type of input device. In some embodiments, the one or more input device(s) 1120 may be a graphical user interface (GUI). Further, the computing system 1100 may include one or more output device(s) 1110, such as a screen (e.g., a liquid crystal display (LCD), a plasma display, or a touchscreen), a printer, external storage, or any other output device. One or more of the output device(s) 1110 may be the same or different from the input device(s) 1120. The computing system 1100 may be connected to a network system 1130 (e.g., a local area network (LAN), a wide area network (WAN) such as the Internet, a mobile network, or any other type of network) via a network interface connection.

In one or more embodiments, for example, the input device 1120 may be coupled to a receiver and a transmitter used for exchanging communications with one or more peripherals connected to the network system 1130. The transmitter may relay information received by the receiver to other elements of the computing system 1100. Further, the computer processor(s) 1104 may be configured for performing or aiding in implementing the processes described in reference to FIGS. 1-10.

Further, one or more elements of the computing system 1100 may be located at a remote location and may be connected to the other elements over the network system 1130. The network system 1130 may be a cloud-based interface that performs processing at a remote location, away from the well site, and that is connected to the other elements over a network. In this case, the computing system 1100 may be connected through a remote connection established using a 5G connection, such as protocols established in Release 15 and subsequent releases of the 3GPP/New Radio (NR) standards.

The computing system of FIG. 11 may include or may be connected to a data repository. The data repository may be a database. A database is a collection of information configured for ease of data retrieval, modification, re-organization, and deletion. In some embodiments, the database includes measured data relating to the methods, the systems, and the devices as described in reference to FIGS. 1-10.

While FIGS. 1-11 show various configurations of components, other configurations may be used without departing from the scope of the disclosure. For example, various components may be combined to create a single component. As another example, the functionality performed by a single component may be performed by two or more components.

Although only a few example embodiments have been described in detail above, those skilled in the art will readily appreciate that many modifications are possible in the example embodiments without materially departing from this description. Accordingly, all such modifications are intended to be included within the scope of this disclosure as defined in the following claims. In the claims, means-plus-function clauses are intended to cover the structures described herein as performing the recited function and not only structural equivalents, but also equivalent structures. It is the express intention of the applicant not to invoke 35 U.S.C. § 112(f) for any limitations of any of the claims herein, except for those in which the claim expressly uses the words "means for" together with an associated function.

What is claimed is:

1. A method for improving permeability of a formation, comprising:

arranging a drilling tool in a wellbore of a well, in proximity to a formation zone identified for drilling;

drilling, using one or more side drill bits of the drilling tool, one or more paths into the formation zone based on a drilling program, wherein the one or more side drill bits are coupled to a running base pipe of the drilling tool via tubes;

accessing real-time sensor data pertaining to at least one of a reservoir parameter, a formation parameter, or a tool condition parameter, the real-time sensor data being captured by one or more sensors inside the well;

updating, using one or more hardware processors, the drilling program based on the real-time sensor data;

adjusting the drilling of the one or more paths based on the updated drilling program;

expanding a tube of a particular side drill bit of the one or more side drill bits outward toward the formation to arrange the particular side drill bit in proximity of the formation zone; and pushing, using a pressure buildup in the drilling tool, the tube outward toward the formation to cause the particular side drill bit to cut into the formation, the pushing of the tube resulting in an expansion of the tube to a length of the tube, wherein the length of the tube is determined based on a drilling path calculated for the particular side drill bit.

2. The method of claim 1, wherein the drilling is performed using the pressure buildup in the drilling tool.

3. The method of claim 1, wherein the one or more side drill bits are coupled to the running base pipe of the drilling tool via a bit base of the drilling tool, the method further comprising:

expanding the bit base outward toward the formation to arrange the one or more side drill bits in proximity of the formation zone; and upon completing the drilling program, retracting the bit base inward toward the running base pipe of the drilling tool.

4. The method of claim 1, wherein the updating of the drilling program based on the real-time sensor data includes:

calculating the drilling path for the particular side drill bit based on the real-time sensor data.

5. The method of claim 1, further comprising:

upon completing the drilling program, retracting the tube of the particular side drill bit inward toward the running base pipe of the drilling tool; and removing the drilling tool from the well.

6. The method of claim 1, wherein the drilling includes:

cutting one or more core samples out of the formation at the formation zone, the cutting being performed using the one or more side drill bits of the drilling tool; and collecting the one or more core samples using a core catcher of the drilling tool.

7. The method of claim 1, wherein the drilling includes:

adjusting a particular side drill bit of the one or more side drill bits to a specific angle based on the adjusted path for the particular side drill bit.

8. The method of claim 1, wherein the updating of the drilling program includes:

determining a condition pertaining to the at least one of the reservoir parameter, the formation parameter, or the tool condition parameter;

modifying an attribute of the one or more paths based on the determined condition; and generating an instruction for the drilling tool to make an adjustment to the drilling of the one or more paths based on the modified attribute of the one or more paths, and wherein the adjusting of the drilling of the one or more paths includes executing the instruction during a drilling process.

9. A drilling tool comprising:

a running base pipe;

a core catcher;

a bit base coupled to the running base pipe, the bit base being expandable, using a pressure buildup in the drilling tool, outward toward a formation;

one or more tubes coupled at one end to the bit base, the one or more tubes being expandable, using the pressure buildup in the drilling tool, outward toward the formation; and one or more side drill bits coupled to the other end of the one or more tubes, the one or more side drill bits being configured to drill one or more paths in the formation at a formation zone based on a drilling program, wherein the drilling includes:

cutting one or more core samples out of the formation at the formation zone, the cutting being performed using the one or more side drill bits of the drilling tool; and collecting the one or more core samples using the core catcher of the drilling tool.

10. The drilling tool of claim 9, wherein the drilling is performed using the pressure buildup in the drilling tool.

11. A system comprising:

one or more sensors arranged in a well to capture real-time sensor data pertaining to at least one of a reservoir parameter, a formation parameter, or a tool condition parameter;

a drilling tool arranged in a wellbore of the well to drill, using one or more side drill bits of the drilling tool, one or more paths into a formation zone of a formation based on a drilling program;

an access module operatively connected to the one or more sensors and configured to access the real-time sensor data captured by the one or more sensors inside the well; and one or more hardware processors operatively connected to the access module and the drilling tool, and configured to:

arrange the drilling tool in the wellbore, in proximity to the formation zone;

cause an operation of the drilling tool based on the drilling program;

update the drilling program based on the real-time sensor data; and cause an adjustment of the drilling of the one or more paths based on the updated drilling program, wherein the one or more side drill bits are coupled to a running base pipe of the drilling tool via tubes, and wherein the causing of the operation of the drilling tool includes:

expanding a tube of a particular side drill bit of the one or more side drill bits outward toward the formation to arrange the particular side drill bit in proximity of the formation zone; and pushing, using a pressure buildup in the drilling tool, the tube outward toward the formation to cause the particular side drill bit to cut into the formation, the pushing of the tube resulting in an expansion of the tube to a length of the tube, wherein the length of the tube is determined based on a drilling path calculated for the particular side drill bit.

12. The system of claim 11, wherein the drilling is performed using the pressure buildup in the drilling tool.

13. The system of claim 11, wherein the one or more side drill bits are coupled to the running base pipe of the drilling tool via a bit base of the drilling tool, and wherein the causing of the operation of the drilling tool includes:

expanding the bit base outward toward the formation to arrange the one or more side drill bits in proximity of the formation zone; and upon completing the drilling program, retracting the bit base inward toward the running base pipe of the drilling tool.

14. The system of claim 11, wherein the updating of the drilling program based on the real-time sensor data includes:

calculating the drilling path for the particular side drill bit based on the real-time sensor data.

15. The system of claim 11, further comprising:

upon completing the drilling program, retracting the tube of the particular side drill bit inward toward the running base pipe of the drilling tool; and removing the drilling tool from the well.

16. The system of claim 11, wherein the drilling includes:

adjusting a particular side drill bit of the one or more side drill bits to a specific angle based on the adjusted path for the particular side drill bit.

17. The system of claim 11, wherein the updating of the drilling program includes:

determining a condition pertaining to the at least one of the reservoir parameter, the formation parameter, or the tool condition parameter;

modifying an attribute of the one or more paths based on the determined condition; and generating an instruction for the drilling tool to make an adjustment to the drilling of the one or more paths based on the modified attribute of the one or more paths, and wherein the causing of the adjustment of the drilling of the one or more paths includes executing the instruction during a drilling process.

18. A system comprising:

one or more sensors arranged in a well to capture real-time sensor data pertaining to at least one of a reservoir parameter, a formation parameter, or a tool condition parameter;

a drilling tool arranged in a wellbore of the well to drill, using one or more side drill bits of the drilling tool, one or more paths into a formation zone of a formation based on a drilling program;

an access module operatively connected to the one or more sensors and configured to access the real-time sensor data captured by the one or more sensors inside the well; and one or more hardware processors operatively connected to the access module and the drilling tool, and configured to:

arrange the drilling tool in the wellbore, in proximity to the formation zone;

cause an operation of the drilling tool based on the drilling program;

update the drilling program based on the real-time sensor data; and cause an adjustment of the drilling of the one or more paths based on the updated drilling program, wherein the drilling includes:

cutting one or more core samples out of the formation at the formation zone, the cutting being performed using the one or more side drill bits of the drilling tool; and collecting the one or more core samples using a core catcher of the drilling tool.

* * * * *